United States Patent [19]

Itabashi

[11] Patent Number: 4,874,687

[45] Date of Patent: Oct. 17, 1989

[54] METHOD FOR FORMING AN IMAGE

[75] Inventor: Masamichi Itabashi, Kanagawa, Japan

[73] Assignee: Fuji Photo Film Co., Ltd., Kanagawa, Japan

[21] Appl. No.: 122,716

[22] Filed: Nov. 18, 1987

[30] Foreign Application Priority Data

Nov. 18, 1986 [JP] Japan ..... 61-274917

[51] Int. Cl.[4] ..... G03C 5/24; G03C 5/36; G03C 5/38; G03C 1/30

[52] U.S. Cl. ..... 430/446; 430/451; 430/452; 430/567; 430/621; 430/622; 430/626; 430/955; 430/967

[58] Field of Search ..... 430/446, 451, 621, 622, 430/626, 955, 452, 567, 967

[56] References Cited

U.S. PATENT DOCUMENTS

| | | | |
|---|---|---|---|
| T873,003 | 4/1970 | Donivan | 430/621 |
| 3,041,170 | 6/1962 | Haist et al. | 430/955 |
| 3,260,598 | 7/1966 | Yutzy et al. | 430/206 |
| 3,490,911 | 1/1970 | Burness et al. | 430/621 |
| 4,054,458 | 10/1977 | Ohtani et al. | 430/621 |
| 4,104,302 | 8/1978 | Smith et al. | 430/621 |
| 4,140,530 | 2/1979 | Trunley et al. | 430/569 |
| 4,216,108 | 5/1980 | Sels et al. | 430/626 |
| 4,421,846 | 12/1983 | Ikeuchi et al. | 430/621 |
| 4,612,277 | 9/1986 | Inagaki et al. | 430/955 |
| 4,670,377 | 6/1987 | Miyoshi et al. | 430/626 |
| 4,791,048 | 12/1988 | Hirai et al. | 430/372 |

*Primary Examiner*—Mukund J. Shah

*Attorney, Agent, or Firm*—Sughrue, Mion, Zinn, Macpeak & Seas

[57] ABSTRACT

A method for forming an image comprising the steps of:

(a) imagewise exposing a light-sensitive silver halide photographic material comprising a support having provided on at least one surface thereof a light-sensitive silver halide emulsion, at least one of an active halogen hardening agent and a bisvinylsulfone hardening agent, and a slightly water-soluble basic metallic compound; and (b) developing said exposed material with a developer solution containing a compound capable of reacting with said basic metallic compound to release a base.

27 Claims, No Drawings

METHOD FOR FORMING AN IMAGE

FIELD OF THE INVENTION

The present invention relates to a method for forming an image using a silver halide photosensitive material and in particular, to a method for forming an image having good graininess with superior development characteristics.

BACKGROUND OF THE INVENTION

Image formation for silver halide photographs is, in general, carried out utilizing the reducing effect of developing agent such as hydroquinone, or the like contained in a developing solution. In this process, the activity of a developing agent increases, and the rate of development increases, with a decrease in the concentration of hydrogen ions in the developing solution, that is, with an increase in the pH of the solution. Thus, a conventional developing solution contains a dissolved alkali agent, such as sodium hydroxide, to provide a high pH value. However, a solution of high pH is difficult to handle and must be handled carefully, and a developing agent in such a developing solution of high pH value is easily oxidized by oxygen in the air, so that such a developing solution has disadvantages.

To overcome these problems, a method using a combination of sodium oxalate and zinc hydroxide has been disclosed in U.S. Pat. No. 3,260,598. According to this method, one of these two compounds is added to a silver halide light-sensitive material, the other is added to a treating solution. By developing the light-sensitive material, the two compounds react with each other, so as to release an alkali and to increase the pH value.

However, this method provides an image having deteriorated graininess.

To improve graininess, the grain size of the silver halide emulsion is reduced, but this is not useful, because it lowers the sensitivity of the light-sensitive material. Other methods are proposed which use hardening agents such as formaldehyde and the like, for example, the compounds mentioned in U.S. Pat. Nos. 2,080,019, 2,725,294, 2,725,295, 2,725,305, 2,726,162, 2,732,316, 2,870,013, 2,950,197, and 3,103,437, and Canadian Pat. No. 588,451. However, those methods do not have sufficiently improved graininess.

Further, it has been proposed to increase the iodine content in silver halide emulsion grains in a silver halide black-and-white negative photographic material, but this method has not sufficiently improved graininess.

SUMMARY OF THE INVENTION

An object of the invention is to provide a method for forming an image using a silver halide which provides an image having excellent development characteristics, in particular, an image being excellent in a development accelerating effect and also having excellent graininess.

The above and other objects have been attained by a method for forming an image comprising the steps of:

(a) imagewise exposing a light-sensitive silver halide photographic material comprising a support having provided on at least one surface thereof a light-sensitive silver halide emulsion, at least one of an active halogen hardening agent and a bisvinylsulfone hardening agent, and a slightly water-soluble basic metallic compound; and (b) developing said exposed material with a developer solution containing a compound capable of reacting with said basic metallic compound to release a base.

DETAILED DESCRIPTION OF THE INVENTION

The present invention will now be described in greater detail below.

In the method for forming an image of the present invention, a silver halide light-sensitive material is treated with a developing solution. The light-sensitive material contains at least one of an active halogen hardening agent and a bisvinylsulfone hardening agent, and also a basic metallic compound slightly soluble in water. Additionally, a compound which can react with a metallic ion contained in the above-mentioned basic metallic compound to form a complex) hereinafter referred to as a "complex forming compound") is contained in the developing solution. In the development step, a complex is formed between the complex forming compound and the metallic ion constituting the basic metallic compound and as a result, a base is formed in the photosensitive material.

It is necessary that a photosensitive silver halide, the above-mentioned hardening agent, and above-mentioned basic metallic compound be present on the same side of the support. These components are preferably present in the same layer or in the layers adjacent to each other. The combination may be disposed on each of the both sides of the support.

The active halogen hardening agent contained in the light-sensitive material of the present invention is preferably represented by formula (I) or (II):

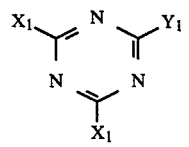

(I)

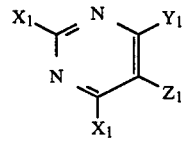

(II)

wherein $X_1$ represents a halogen atom, an N-methylolamino group, or a glycidoxy group; and $Y_1$ and Z, which may be the same or different, each represents a hydrogen atom; a halogen atom; —OH; —OM, wherein M represents an alkali metal ion; a substituted or unsubstituted amino group, wherein the substituent include, e.g., a phenyl group, a sulfophenyl group, a carboxyphenyl group, an alkyl group, a sulfoalkyl group, a carboxyalkyl group, and a hydroxyalkyl group; a substituted or unsubstituted alkyl ether group; a substituted or unsubstituted phenyl ether group; a substituted or unsubstituted alkyl thioether group; a substituted or unsubstituted phenyl thio ether group; a sulfonamido group; or an alkyl sulfonamide group. The alkyl moiety and the phenyl moiety in the group $Y_1$ Or $Z_1$ preferably contain 10 or less of carbon atoms.

Specific examples of compounds represented by formula (I) of the invention include the following compounds, but the present invention is not to be construed as being limited thereto.

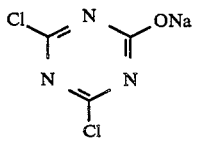
(I-1)
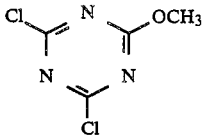
(I-2)
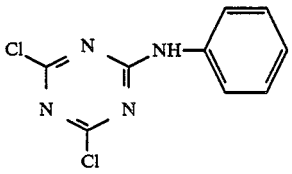
(I-3)
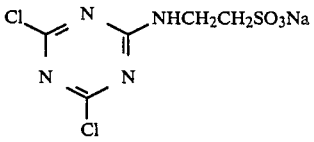
(I-4)
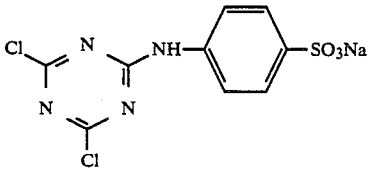
(I-5)
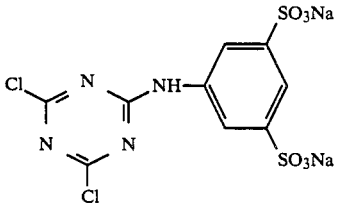
(I-6)
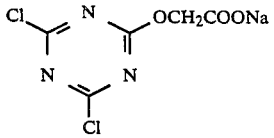
(I-7)
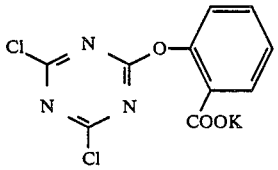
(I-8)
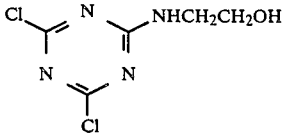
(I-9)
-continued
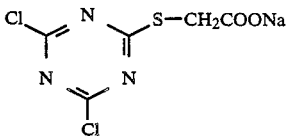
(I-10)
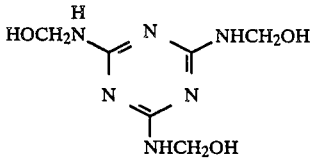
(I-11)
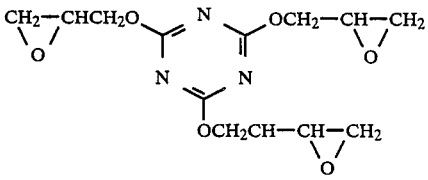
(I-12)
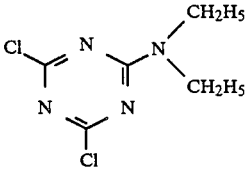
(I-13)
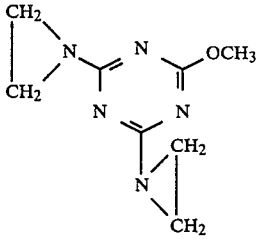
(I-14)
Specific examples of compounds represented by formula (II) in the invention are as follows, but the present invention is not to be construed as being limited these to.
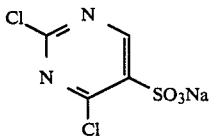
(II-1)
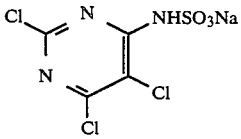
(II-2)
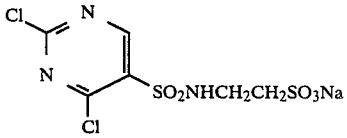
(II-3)

-continued

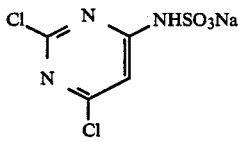

(II-4)

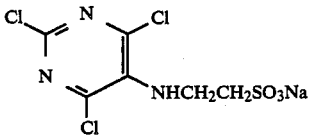

(II-5)

In preferred compounds represented by formula (I) or (II), $X_1$ represents a chlorine atom.

As $Y_1$, various groups can be selected but —OM where M represent an alkali metal ion, and alkylamino or arylamino groups substituted by a water-soluble group such as a sulfonic group, a carboxyl group, or the like are preferred.

Particularly preferred compounds are (I-1), (I-2), (I-4) and (I-10).

The compound represented by formula (I) or (II) is preferably used in an amount of from about $0.5\times10^{3}$ to $1\times10^{-1}$ mol, more preferably from about $1.0\times10^{-3}$ to $3\times10^{-2}$ mol per 100 g of gelatin or other hardenable binders contained in the light-sensitive material.

The bisvinylsulfone hardening agent contained in the light-sensitive material of the present invention is preferably represented by formula (III):

$$CH_2{=}CHSO_2\text{-}R_{11}\text{-}SO_2CH{=}CH_2 \qquad \text{(III)}$$

where $R_{11}$ represents a divalent linking group selected from an unsubstituted alkylene group; an alkylene group substituted with a halogen atom, a hydroxyl group, a hydroxyalkyl group or an amino group; and $R_{11}$ may contain —CONH—, —O—, or —S—.

Specific examples of compounds represented by formula (III) are as follows, but the present invention is not to be construed as being limited thereto.

$$CH_2{=}CHSO_2CH_2SO_2CH{=}CH_2 \qquad \text{(III-1)}$$

$$CH_2{=}CHSO_2(CH_2)_{SO2}CH{=}CH_2 \qquad \text{(III-2)}$$

$$CH_2{=}CHSO_2(CH_2)_4SO_2CH{=}CH_2 \qquad \text{(III-3)}$$

$$CH_2{=}CHSO_2CH_2OCH_2SO_2CH{=}CH_2 \qquad \text{(III-4)}$$

$$CH_2{=}CHSO_2(CH_2)_2O(CH_2)SO_2CH{=}CH_2 \qquad \text{III-5)}$$

$$CH_2{=}CHSO_2CH_2\overset{OH}{\overset{|}{C}}HCH_2SO_2CH{=}CH_2 \qquad \text{(III-6)}$$

$$\left.\begin{array}{l} CH_2{=}CHSO_2CH_2CONH- \\ CH_2{=}CHSO_2CH_2CONH- \end{array}\right\}(CH_2)_2 \qquad \text{(III-7)}$$

$$\left.\begin{array}{l} CH_2{=}CHSO_2CH_2CONH- \\ CH_2{=}CHSO_2CH_2CONH- \end{array}\right\}(CH_2)_3 \qquad \text{(III-8)}$$

In preferred compounds represented by formula (III), $R_{11}$ represents $$\text{-}(CH_2)_5O(CH_2)_5\text{-},\ \text{-}(CH_2)_5\overset{OH}{\overset{|}{C}}H(CH_2)_5\text{-},\ \text{or}$$

$$\text{-}CH_2CONH(CH_2)_5NHCOCH_2\text{-},$$

wherein s represents an integer from 1 to 5.

Particularly preferred compounds are (III-4), (III-6), (III-7), and (III-8).

These compounds are used in an amount of about $1.0\times10^{-3}$ to $1.0\times10^{-1}$ mol, preferably about $3.0\times10^{-3}$ to $3.0\times10^{-2}$, mol per 100 g of gelatin or other hardenable binders contained in the light-sensitive material.

The active halogen hardening agent and bisvinylsulfone hardening agent may be used alone or in combination in the present invention. The hardening agent may be added to a silver halide emulsion layer, a protective layer, an undercoat layer or the like.

The basic metallic compound slightly soluble in water contained in the light-sensitive material of the present invention is preferably a compound which has a solubility at 25° C. of about 0.5 or less in water, that is, about 0.5 g or less of the substance can be dissolved in 100 g of water at 25° C. These compounds include those represented by formula (IV):

$$T_mX_n \qquad \text{(IV)}$$

In formula (IV), T represents a transition metal such as Zn, Ni, Co, Fe, Mn, or the like, or an alkaline earth metal such as Ca, Ba, Mg, or the like, and X represents a basic anion which can be the counter ion of the ion represented by M described below, including carbonate ions, phosphate ions, silicate ions, borate ions, aluminate ions, hydroxide ions, or an oxygen atom. m and n each represents integers required for charge balance.

Preferred examples of the basic metallic compound include calcium carbonate, barium carbonate, magnesium carbonate, zinc carbonate, strontium carbonate, magnesium calcium carbonate ($CaMg(CO_3)_2$), magnesium oxide, zinc oxide, tin oxide, cobalt oxide, zinc hydroxide, aluminum hydroxide, magnesium hydroxide, calcium hydroxide, antimony hydroxide, tin hydroxide, iron hydroxide, bismuth hydroxide, manganese hydroxide, calcium phosphate, magnesium phosphate, magnesium borate, calcium silicate, magnesium silicate, zinc aluminate, calcium aluminate, basic zinc carbonate ($2ZnCO_3\cdot3Zn(OH)_2\cdot H_2O$), basic magnesium carbonate ($3MgCO_3\cdot Mg(OH)_2\cdot3H_2O$), basic nickel carbonate ($NiCO_3\cdot2Ni(OH)_2$), basic bismuth carbonate ($Bi_2(CO_3)O_2\cdot H_2O$), basic cobalt carbonate ($2CoCO_3$—$3Co(OH)_2$), and aluminum magnesium oxide.

Among these compounds, non-colored compounds are most preferred.

The complex forming compound contained in the developing solution of the present invention reacts with the metallic ion in the basic metallic compound to form a complex salt preferably having a stability constant (log K) of about 1 or more.

These complex forming compounds are described in detail in A. E. Mastell and R. M. Smith, *Critical Stability Constants,* Volumes 1 to 5, (Plenum Press).

Specific examples thereof include alkali metal salts, guanidine salts, amidine salts, and quaternary ammonium salts of aminocarboxylic acids, imidine acetic acid and its derivatives, aniline carboxylic acids, pyridine carboxylic acids, aminophosphoric acids, carboxylic acids (mono-, di , tri-, and tetracarboxylic acids and those having a substituent group such as a phosphono group, a hydroxyl group, an oxo group, an ester group, an amide group, an alkoxy group, a mercapto group, an alkylthio group, a phosphino group, the like), hydroxamic acids, polyacrylic acid, polyphosphoric acid, and the like.

Preferred specific examples of complex forming compounds include alkali metal salts, guanidine salts, amidine salts, or quaternary ammonium salts of picolinic acid, 2,6-pyridinedicarboxylic acid, 2,5-pyridinedicarboxylic acid, 4-dimethylaminopyridine-2,6-dicarboxylic acid, quinoline-2-carboxylic acid, 2-pyridine acetic acid, oxalic acid, citric acid, tartaric acid, isocitric acid, malic acid, gluconic acid, ethylenediaminetetraacetic acid (EDTA), nitrilotriacetic acid (NTA), cyclohexanediaminotetraacetic acid (CDTA), hexametaphosphoric acid, tripolyphosphoric acid, tetraphosphoric acid, polyacrylic acid,

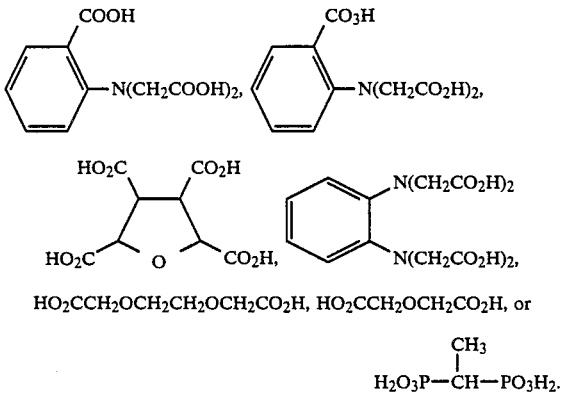

Of these, an aromatic nitrogen-containing heterocyclic compound substituted with at least one —COOM group where M is an alkali metal ion, a guanidine ion, an amidine ion, or a quaternary ammonium ion, is particularly preferred. The heterocyclic ring may be a single ring or a condensed ring, and as the ring, for example, a pyridine ring, a quinoline ring, and the like are mentioned. It is particularly preferred that the —COOM group be bonded to the ring at the α-position to the nitrogen atom.

Preferred compounds thereof include those represented by formula (V):

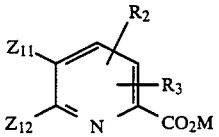

(V)

In formula (V), $R_2$, $R_3$, $Z_{11}$ and $Z_{12}$. Which may be the same or different, each represents a hydrogen atom, an aryl group, a halogen atom, an alkoxy group, —COOM, a hydroxycarbonyl group, or an electron-donating groups selected from an amino group, a substituted amino group, an alkyl group; provided that $Z_{11}$ and $Z_{12}$ may be linked to from a ring; and M represents an alkali metal ion, a substituted or unsubstituted guanidium ion, an amidinium ion, or a quaternary ammonium ion.

Preferred examples of combinations of the basic metallic compound slightly soluble in water and the complex forming compound are as follows, but the present invention is not to be construed as being limited thereto. In the following, M⊕ represents an alkali metal ion, a substituted or unsubstituted guanidinium ion, an amidinium ion, or a quaternary ammonium ion.

Calcium carbonate -

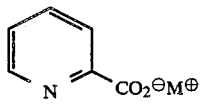

Basic zinc carbonate -

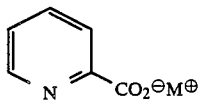

Basic magnesium carbonate -

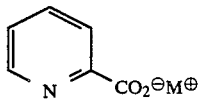

Barium carbonate - $\ominus M\oplus O_2C.CO_2\oplus M\ominus$

Calcuim carbonate - M⊖ salt of tripolyphosphoric acid

Calcuim carbonate - M⊖ salt of critric acid

Calcium carbonate -

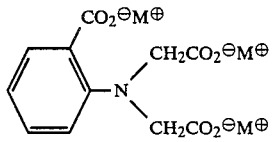

Magnesium oxide -

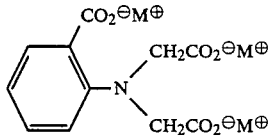

Zinc hydroxide -

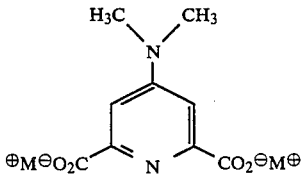

Tin hydroxide -

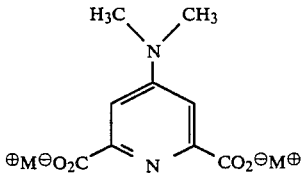

Magnesium hydroxide - M⊕ salt of hexametaphosphoric acid

-continued

Calcium carbonate -

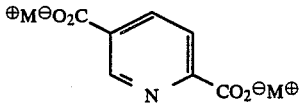

Basic magnesium carbonate - $^{\oplus}M^{\ominus}O_2C.CO_2^{\ominus}M^{\oplus}$

Calcium carbonate -

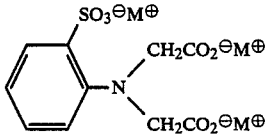

Basic zinc carbonate -

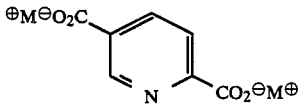

These combinations can be used alone or in combination of two or more thereof.

Without being limited in any way by theory, it is considered that the mechanism by which a base is formed in the developing solution of the invention is as follows, taking a combination of potassium picolinate with zinc hydroxide as an example.

The reaction of the compound is shown, for example, by the following reaction scheme.

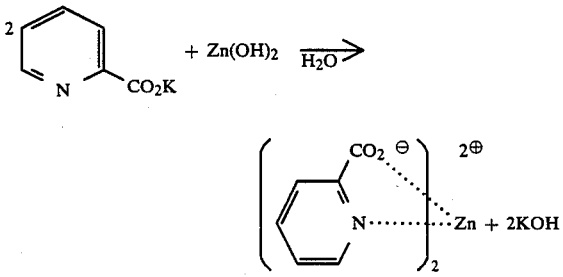

When water in the developing solution contacts the compounds, a complex forming reaction of picolinic acid ions with zinc ions occurs to form a base.

The progress of the reaction depends upon the stability of the complex formed. The stepwise stability constants of complexes formed from picolinic acid ions ($L^{\ominus}$) and zinc ions ($M^{\oplus}$) and corresponding to ML, $ML_2$, and $ML_3$ is very large as shown below, by which the steady progress of the reaction is explained.

| | ML | $ML_2$ | $ML_3$ |
|---|---|---|---|
| log k | 5.30 | 9.62 | 12.92 |

It is preferred that the basic metallic compound slightly soluble in water be present n the form of a fine power dispersion prepared by processes mentioned in Japanese Patent Application (OPI) Nos. 147830/84 and 102733/78 (the term "OPI" as used herein means an "unexamined published application"). The average particle size of the metallic compound is preferably about 50 μm or less, more preferably about 5 μm or less.

The basic metallic compound may be added to any of on emulsion layer, intermediate layer, protective layer, antihalation layer, and white pigment layer, in the light-sensitive material of the present invention, and it may present in one layer or in two or more layers.'

The amount of the basic metallic compound added is preferably from about 0.01 to 20 g/m$^2$, and more preferably from 0.1 to 5 g/m$^2$. The amount of the complex forming compound contained in the developer is preferably an amount of 1/5 times or more by mole the amount of the basic metallic compound to be reacted with, and generally is in the range of from about 0.1 to 5 mol/l.

As the silver halide contained in the light-sensitive silver halide emulsion used in the present invention, any of silver chloride, silver chlorobromide, silver bromide, silver iodobromide, and silver chloroiodobromide can be used, but silver iodobromide is preferred. It is preferred that the silver iodide content in the silver iodobromide be within a range of about 30 mol % or less, more preferably about 15 mol % or less. The iodide may be distributed uniformly in silver iodobromide grains or a difference in iodide distribution may exist between the inside and the surface of the grain.

A preferred average grain size is about 0.3 μm or more, and a particularly preferred grain size is from about 0.5 to 2.0 μm.

The distribution of grain size may be narrow or may be broad.

The silver halide grains in the emulsion may have a regular crystalline form such as cubic, octahedral, tetradecahedral, or rhombic dodecahedral; an irregular crystalline form such as sphereoid, tabular, or pebble like, or a composite form of these crystalline forms, or may contain a mixture of grains of different crystalline forms. The silver halide grains may be tabular grains having an aspect ratio (grain diameter to grain thickness) of 5 or more. (Tabular grains are described in detail in *Research Disclosure* Vol. 225, Item 22534, pages 20 to 58, (Jan., 1983) and in Japanese Patent Application (OPI) Nos. 127921/83 and 113926/83.)

In the light-sensitive silver halide emulsion used in the present invention, two or more types of silver halide emulsions may be mixed and used. These emulsions may differ from each other in a grain size, in a halogen composition, and in sensitivity. A substantially non-light-sensitive silver halide emulsion (which may be an emulsion fogged intentionally on the surface or in the interior of the grains, or an emulsion without such treatment) may be mixed into a light-sensitive emulsion, or it may be present in a different layer. Such non-light-sensitive emulsions are described in detail in U.S. Pat. Nos. 2,996,382 and 3,397,987. For example, a light-sensitive silver halide emulsion containing spherical or pebble like grains and a light-sensitive silver halide emulsion containing tabular grains having an aspect ratio of 5 or more may be used in the same layer, or may be used in different layers, as disclosed in Japanese Patent Application (OPI) No. 127921/83. If the two light-sensitive emulsions are present in different layers, the emulsion containing tabular grains may be contained in a layer near the support or a layer further from the support.

Photographic emulsions used in the present invention can be prepared by any of the conventional methods described in P. Glafkides, *Chimie et physique Photographique* (Paul Montel 1967); G. F. Duffin, *Photographic*

*Emulsion Chemistry* (Focal Press 1966); V. L. Zelikman et. al., *Marking and Coating Photographic Emulsion* (Focal Press 1964), and in Japanese Patent Application (OPI) Nos. 127921/83 and 113926/83.

Any of an acid process, neutral process, and ammonia process can be used. For reacting a soluble silver salt with a soluble halogen salt, any of a single jet process, a double jet method, and a combination of these can be used.

A process for forming silver halide grains in the presence of an excess of silver ions (i.e., a reverse jet process) can also be used. A double jet process maintaining the pAg constant in the liquid phase in which the silver halide is formed, i.e., a controlled double jet process, can also be used. By this method, a silver halide emulsion containing silver halide grains having a regular crystalline form and a nearly uniform grain size can be obtained easily.

The silver halide grains may have a crystalline structure that is uniform from the surface to the inside, or a lamellar structure in which the inside and the outside are heterogeneous, or they may conversion grains described in British Pat. No. 635,841 and in U.S. Pat. No. 3,622,318. Further, in the silver halide grains, two types of silver halides different in composition may be joined with each other by epitaxial junctions, or a silver halide may be joined with a silver compound other than a silver halide, for example, silver rhodanine, silver oxide, or the like, or with a compound other than a silver compound. The silver halide grains may be of surface latent image type or may be of internal image type. In a silver halide grain forming process or in a physical ripening process for the prepared silver halide grains a cadmium salt, a zinc salt, a lead salt, a thallium salt, an iridium salt or its complex salt, a rhodium salt or its complex salt, an iron salt or its complex salt, or the like may be present.

When the grains are formed, a solvent for silver halides such as ammonia, a thioether compound, thiazolidine-2-thione, a tetra-substituted thiourea, potassium rhodanate, ammonium rhodanate, or an amine compound may be used to control the growth of grains.

Silver halide emulsions used in the present invention may be chemically sensitized or may not be sensitized. As a chemical sensitization method, a sulfur sensitization method, a reduction sensitization method, a noble metal sensitization method, and the like which are well known can be used alone or in a combination of two or more methods.

An example of noble metal sensitization methods is a gold sensitization method, in which gold compounds, and in particular, gold complex salts, are used. A complex salt of a noble metal other than gold, for example, platinum, palladium, iridium, or the like may be present in the gold complex salt. Specific examples of these complex salts are disclosed in U.S. Pat. No. 2,448,060 and in British Pat. No.618,061.

As a sulfur sensitizing agent, in addition to sulfur compounds contained in gelatin, various sulfur compounds, for example, thiosulfates, thioureas, thiazoles, rhodanines, and the like can be used. Specific examples of sulfur sensitizing agents are disclosed in U.S. Pat. Nos. 1,574,944, 2,278,947, 2,410,689, 2,278,668, 3,501,313, and 3,656,955.

Examples of reduction sensitizing agents include stannous salts, amine salts, form amidine sulfinic acid, silane compounds, and the like. Specific examples of these are disclosed in U.S. Pat. Nos. 2,487,850, 2,518,698, 2,983,609, 2,983,610, and 2,694,637.

The photographic emulsions used in the invention can contain various compounds in order to prevent fog formation during the manufacturing process for the light-sensitive material, a storage period, or a processing of the material, or for stabilizing the photographic performance of light-sensitive material. Various conventional antifoggants and stabilizers can be present in the photographic emulsions, including azoles (for example, benzothiazolium salts, nitroimidazoles, nitrobenzimidazoles, chlorobenzimidazoles, bromobenzimidazoles, nitroindazoles, benzotriazoles, aminotriazoles, and the like); mercapto compounds (for example, mercaptothiazoles, mercaptobenzothiazoles, mercaptobenzimidazoles, mercaptothiadiazoles, marcaptotetrazoles (in particular, 1-phenyl-5-mercaptotetrazole), mercaptopyrimidines, mercaptotriazines, and the like); thioketo compounds such as oxazoline thione; azaindenes (for example, triazaindenes, tetraazaindenes (in particular, 4-hydroxy substituted (1,3,3a,7)tetrazaindenes, pentazaindenes, and the like); benzene thiosulfonic acid; benzene sulfinic acid; benzene sulfonamide, etc.

Specific examples are described in *Research Disclosure* 17643, VI (Dec., 1978, pages 24–25) and in the publications cited therein.

In particular, nitron compounds and their derivatives described in Japanese Patent Application (OPI) Nos. 76743/85 and 87322/85; mercapto compounds described in Japanese Patent Application (OPI) No. 80839/85; and heterocyclic compounds and complex salts of heterocyclic compounds and silver (for example, 1-phenyl-5-mercaptotetrazole silver) described in Japanese Patent Application (OPI) No. 164735/82 can be preferably used.

The light-sensitive silver halide emulsions of the present invention may be spectrally sensitized in regions of visible wavelength, blue light, green light, red light, and infrared light. As the sensitizing dye, cyanine dyes, merocyanine dyes, complex cyanine dyes, complex merocyanine dyes, holopolar cyanine dyes, styryl dyes, hemicyanine dyes, oxonole dyes, hemioxonole dyes, and the like can be used.

Useful sensitizing dyes used in the invention are described, for example, in Research Disclosure, 17643, IVA page 23 (Dec., 1978), and ibid 1831, X, page 437 (Aug., 1979), and publications cited therein.

The sensitizing dye can be added to a photographic emulsion in any of the manufacturing processes for a photographic emulsion, or may be added at any stage after the photographic emulsion is prepared until it is applied to a support. In the former case, the sensitizing dye is added, for example, during the grain formation process, a physical ripening process, or a chemical ripening process for the silver halide grains.

In the photographic emulsion layer or another hydrophylic colloid layer of the light-sensitive material of the present invention, various surface active agents may be present as coating assistants, or for prevention of static electricity, improvement of lubrication, emulsification and dispersion, prevention of adhesion, and improvement of photographic characteristics (for example, accelerating development, increasing contrast, and increasing sensitivity).

Suitable surface active agents, for example, include nonionic surface active agents such as saponins (steroid type), alkylene oxide derivatives (for example polyethylene glycol, condensates of polyethylene glycol/polypropylene glycol, polyethylene glycol alkyl ethers, polyethylene glycol alkylaryl ethers, polyethylene glycol esters, polyethylene glycol sorbitane ethers, polyalkylene glycol alkylamines or alkylamides, and adducts of silicone with polyethylene oxide), glycidol derivatives (for example, polyglycerides of alkenyl succinic acid, and alkylphenol polyglycerides), fatty acid esters of polyhydric alcohols, alkyl esters of sugars, and the like; anionic surface active agents containing an acid group such as a carboxyl group, a sulfo group, a phospho group, a sulfuric ester group, or a phosphoric ester group, for example, alkylcarboxylic acid salts, alkylsulfonic acid salts, alkylbenzenesulfonic acid salts, alkylnaphthalenesulfonic acid salts, alkyl sulfuric esters, alkyl phosphoric esters, N-acyl-N-alkyltaurines, sulfosuccinic acid esters, sulfoalkylpolyoxyethylene alkylphenyl ethers, polyoxyethylene alkylphosphoric acid esters, and the like; amphoteric surface active agents such as amino acids, aminoalkyl sulfonic acids, aminoalkyl sulfuric acid esters, aminoalkyl phosphoric acid esters, alkylbetaines, amine oxides, and the like; and cationic surface active agents such as alkylamine salts, aliphatic or aromatic quaternary ammonium salts, heterocyclic quaternary ammonium salts, for example, pyridinium salts, imidazolium salts, and the like, and phosphonium or sulfonium salts containing an aliphatic group or a heterocyclic ring.

These surface active agents are described in Ryohei Oda, *Kaimenkasseizai to sono Oyo* (Surface Active Agents and Applications), (Maki Shoten, 1964), in Hiroshi Horiguchi, *Shin Kaimenkasseizai* (New Surface Active Agents), (Sankyo Publishing Co., 1975), *McCutcheon's Deterqents and Emulsifiers,* (McCutcheon Divisions, M,C. Publishing to, 1985), in Japanese Patent Application (OPI) No. 76741/85, and in Japanese Patent Application Nos. 13398/86, 16056/86, and 32462/86.

As the antistatic agent, fluorine-containing surface active agents or polymers described, in particular, in Japanese Patent Application (OPI) Nos. 74554/84 and 80849/85, and in Japanese Patent Application Nos. 249021/85 and 32462/86; nonionic surface active agents described in Japanese Patent Application (OPI) Nos. 76742/85, 80846/85, 80848/85, 80839/85, 76741/85, and 208743/83, and in Japanese Patent Application Nos. 13398/86, 16056/86, and 32462/86; and conductive polymers or latexes (nonionic, anionic, cationic, or amphoteric) disclosed in Japanese Patent Application (OPI) No. 204540/82 and in Japanese Patent Application No. 32462/86 can preferably be used.

Further, inorganic antistatic agents, such as halides, nitrates, perchlorates, sulfates, acetates, phosphates, and thiocyanates of ammonium, alkali metals, alkali earth metals, and conductive tin oxide, zinc oxide, and composite oxides prepared by doping these metal oxides with antimony or the like in Japanese Patent Application (OPI) No. 118242/82 can preferably be used. Further, various charge-transfer complexes; doped or undoped $\pi$-conjugated system high molecular compounds; organometallic compounds; and interlaminar compounds can also be used as an antistaic agent. For example, polyacetylene, polypyrrole and the like can be used. These compounds are described in Morita et, al., *Kaqaku to Kogyo* (Science and Industry), 59(3), 103–111 (1985) and ibid, 59(4), 146–152 (1985).

Matting agents can be used in the present invention, including fine powders of organic compounds such as polymethyl methacrylate, a methyl methacrylate/methacrylic acid copolymer, and starch; and of inorganic compounds such as silica, titanium oxide, strontium sulfate and barium sulfate can be used. The particle size is from about 1.0 to 10 $\mu$m, preferably from about 2 to 5 $\mu$m. Examples thereof are described in U.S. Pat. Nos. 2,992,101, 2,701,245, 4,142,894, 4,396,706, etc.

In the surface layer of the light-sensitive material of the present invention, in addition to the silicone compounds disclosed in U.S. Pat. Nos. 3,489,576 and 4,047,958 and colloidal silica described in Japanese Pat. Publication No. 23139/81, paraffin wax, a higher fatty acid latex, starch derivatives, and the like can be used as a lubricating agent.

In the hydrophilic colloid layers of the light-sensitive material of the present invention, polyols such as trimethylol propane, pentane diol, butane diol, ethylene glycol, glycerine, and the like can be used as a plasticizer. It is preferred that a polymer latex be added to the, hydrophilic colloid layers in order to improve the pressure resistance. As the polymer latex, homopolymers of alkyl acrylate or copolymers of alkyl acrylate and acrylic acid; styrene-butadiene copolymers; and homopolymers or copolymers of monomers having an active methylene group preferably can be used.

In the photographic emulsion and non-photo-sensitive hydrophilic colloidal layers of the present invention, inorganic or organic hardening agents other than active halogen compounds and bisvinylsulfone compounds used in the present invention may be incorporated. The hardening agent of the present invention is preferably used in an amount of 1/1 or more, more preferably 4/1 or more, the amount of hardening agents other than those of the present invention. For example, chromium salts (such as chromium alum, chromium acetate, and the like), aldehydes (such as formaldehyde, glyoxal, glutaraldehyde, and the like), N-methylol compounds (such as dimethylol urea, methylol dimethyl hidantoin, and the like), dioxane derivatives (such as 2,3-dihydroxydioxane, and the like), active vinyl compounds (such as 1,3,5-triacryloyl-hexahydro-s-triazine, and the like), mucohalogeno acids (such as mucochloro acid, mucophenoxy chlorine III, and the like), isoxazoles, dialdehyde starch, 2-chloro-6-hydroxytriazinylated gelatin, and the like can be used alone or in combination of two or more compounds.

In the case where the light-sensitive material according to the present invention is used for an X-ray-sensitive material, it is preferred that the hydrophilic colloidal layers be hardened by these hardening agents such that the degree of swelling in water is preferably about 220% or less, more preferably about 180% or less.

As a binder or a protective colloid used in an emulsion layer or in an intermediate layer in the photosensitive material of the invention, gelatin is advantageously used, but hardenable hydrophilic colloids other than gelatin also can be used.

For example, proteins such as gelatin derivatives, graft polymers of gelatin with other high molecular compounds, albumin, casein, and the like; cellulose derivatives such as hydroxyethyl cellulose, carboxymethyl cellulose, cellulose sulfuric esters, and the like; sugar derivatives such as sodium alginate, dextran, starch derivatives, and the like; and many synthetic hydrophilic high molecular substances such as polyvinyl alcohol, partial acetal of polyvinyl alcohol, poly-N-vinylpyrrolidone, polyacrylic acid, polymethacrylic acid, polyacrylamide, polyvinyl imidazole, polyvinyl pyrazole, and copolymers of these can be used.

As gelatin, in addition to lime-treated gelatin, acid-treated gelatin and enzyme-treated gelatin can be used, and a hydrolyzate of gelatin can also be used.

Of these, a combination of dextran and polyacrylamide with gelatin is preferred.

The silver halide photographic material of the invention can contain, in addition to light-sensitive silver halide emulsion layers, light insensitive layers such as a surface protective layer, an intermediate layer, and an antihalation layer.

The silver halide emulsion layer may contain two layers or more, which may differ in sensitivity, gradation, and the like. Further, the silver halide photographic material may have one or more silver halide emulsion layers and light-insensitive layers on both sides of the support.

As a support for the light-sensitive materials, cellulose triacetate is preferred, which may be colored for antihalation or may be colorless.

As a support for the X-ray-sensitive material, a polyethylene terephthalate film or a cellulose triacetate film is preferred, a support which is colored blue is particularly preferred.

To improve the adhesion of hydrophilic colloid layer to the support, the support is preferably corona discharge-treated, glow discharge-treated or irradiated with ultraviolet light on its surface, or may have on its surface a subcoated layer containing a styrene-butadiene latex or a vinylidene chloride latex. In this case, a gelatin layer may further be disposed on the subcoated layer. Further, such a subcoated layer may be coated using an organic solvent containing gelatin and a swelling agent for polyethylene. It is possible to improve the adhesion of these subcoated layers to a hydrophilic colloid layer by applying a treatment to the surface of the subcoated layers.

The present invention can be applied to any light-sensitive material which is processed by conventional development treatment, including for example, photographic materials for X-rays, lith-type photographic materials, black-and-white negative materials, color negative material, color reversal materials, color paper materials, and black-and-white paper materials.

If the present invention is applied to a photographic material for X-rays, it is preferred to use a protective layer (p. 436, Clause IV) and crossover control techniques (p. 436, Clause V) described in "Technology about Stabilizers, Antifoggants, and Knick Mark Inhibitors" *Research Disclosure,* 18431, pages 433 to 436 (Aug., 1979).

A photographic image can be obtained using X-rays by any conventional exposure method, including exposing a light-sensitive material having light-sensitive layers on both sides of a support using X-rays, with the light-sensitive material being contained between two sheets of fluorescent sensitizing paper.

With a light-sensitive material having light-sensitive layers only on one side, a method of irradiating one sheet of fluorescent sensitizing paper with X-rays and recording the emitted light on a light-sensitive material is used. Such irradiation with X-rays may be carried out with the fluorescent sensitizing paper superposed on the light-sensitive material. As the fluorescent substance, a phosphor such as calcium tungstate or barium sulfate emitting blue light, or a rare earth phosphor emitting green light is used. Further, after a fluorescent material i exposed to X-rays, the light-sensitive material can be exposed using the fluorescent material by use of a light source emitting infrared light, such as a cathode ray tube flying spot, a luminous diode, or a laser (for example, a gas laser, a YAG laser, a dye laser, a semiconductor laser, or the like).

For photographic processing of the light-sensitive material of the present invention, conventional methods and treating solutions described, for example, in *Research Disclosure* Vol. 176, pages 28 to 30 (RD-17643) can all be applied. The photographic treatment may be black-and-white photographic processing to from a silver image or color photographic processing to from a dye image. The processing temperature is usually selected within a range of about 18° C., to 50° C. but it may be lower than 18° C. or higher than 50° C.

For example, a developing solution used for the black-and-white photographic treatment typically contains a well known developing agent, such as dihydroxybenzenes (for example, hydroquinone), 3-pyrazolidones (for example, 1-phenyl-3-pyrazolidone), and aminophenols (for example, N-methyl-p-aminophenol), alone or in combination of two or more compounds. For photographic treatment of the light-sensitive material of the present invention, a developing solution containing imidazoles as a solvent for silver halide described in Japanese Patent Application (OPI) No. 78535/82 can be used. Further, a developing solution containing additives such as a solvent for silver halide and indazole or triazole described in Japanese Patent Application (OPI) No. 37643/83 can be used.

The developing solution can contain, in addition to the above-mentioned ingredients, a preservative, an alkali agent, a pH buffering agent, and an antifoggant which are conventionally used and further may contain a dissolution assistant, a toning agent, a development accelerator, a surface active agent, an anti-foaming agent, a hard water softening agent, an emulsion-hardening agent (for example, glutaraldehyde), a viscosity increasing agent, and the like, as desired.

As fixing solution, any generally used composition can be used. As a fixing agent, in addition to thiosulfates and thiocyanates, known organic sulfur fixing agents can be used. The fixing solution may contain a water soluble aluminum salt as a hardening agent.

The present invention is now described in greater detail by reference to specific examples, but the present invention is not to be construed as being limited thereto. Unless otherwise indicated, all parts, percents and ratios are by weight.

EXAMPLE 1

Preparing pebble like silver halide emulsion

An aqueous solution of silver nitrate and an aqueous solution of potassium bromide were added to a solution containing and gelatin in a container according to a conventional ammonia process, and a thick tabular silver bromide emulsion having an average grain size of 1.0 μm and an approximately pebble like form was prepared. The emulsion was chemically sensitized with sodium thiosulfate and chloroauric acid to prepare a light-sensitive silver bromide emulsion (A). Separately, by adding potassium iodide to two aqueous solutions of potassium bromide prepared as above, the same grain formation and chemical sensitization as for emulsion (A) were carried out, and to prepare a light-sensitive silver iodobromide emulsion (B) having an iodine content of 3 mol %, and a light-sensitive silver iodine bromide emulsion (C) having an iodine content of 10 mol %.

Preparing cubic silver halide emulsion

An aqueous solution of silver nitrate and an aqueous solution of potassium bromide were added to a solution containing and gelatin in a container while the pAg in the reaction mixture was maintained at 7.5, and a cubic silver bromide emulsion having an average grain size of 0.9 μm was obtained. The silver bromide emulsion was chemically sensitized with sodium thiosulfate and chloroauric acid and thus a light-sensitive silver bromide emulsion (D) was obtained. By adding potassium iodide to two aqueous solutions of potassium bromide as prepared above, the same grain formation and chemical sensitization as for emulsion (D) were carried out, to prepare a cubic light-sensitive silver iodobromide emulsion (E) having an iodine content of 3 mol %, and a cubic light-sensitive silver iodobromide emulsion (F) having an iodine content of 10 mol %.

Preparing octahedral silver halide emulsion

An aqueous solution of silver nitrate and an aqueous solution of potassium bromide were added to solution containing halogen and gelatin in a container, while the pAg in the reaction mixture was maintained at 8.7, and an exactly octahedral silver bromide emulsion having an average grain diameter of 0.8 μm was obtained. The emulsion was chemically sensitized with sodium thiosulfate and chloroauric acid, and thus an exactly octahedral light-sensitive silver bromide emulsion (G) was obtained. Separately, by adding potassium iodide to two aqueous solutions of potassium bromide prepared as above, the same grain formation and chemical sensitization as for emulsion (G) were carried out to prepare an octahedral light-sensitive silver iodobromide emulsion (H) having an iodine content of 3 mol %, and an octahedral light-sensitive silver iodobromide emulsion (I) having an iodine content of 10 mol %.

Preparing layer of tabular silver halide emulsion having average aspect ratio of 6.5

10% of an aqueous solution of silver nitrate and 10% of an aqueous solution of potassium bromide were added to an aqueous solution containing potassium bromide and gelatin in a container while the pAg in the reaction mixture was maintained at 9.5, and subsequently, an aqueous solution of silver nitrate and an aqueous solution of potassium bromide were added to the reaction mixture while the pAg in the reaction mixture was maintained at 8.4. Thus, a tabular silver bromide emulsion having an average grain diameter of 1.3 μm and an average aspect ratio of 6.5 (based on the projected area of grains) was prepared, and the emulsion was chemically sensitized with sodium thiosulfate and chloroauric acid to obtain light-sensitive silver bromide emulsion (J). Separately, by adding potassium iodide to two aqueous solutions of potassium bromide prepared as above, the same grain formation and chemical sensitization as for emulsion (J) were carried out to prepare a tabular light-sensitive silver iodobromide emulsion (K) having an iodine content of 3 mol %, and a tabular light-sensitive silver iodobromide emulsion (L) having an iodine content of 10 mol %.

Preparing tabular silver halide emulsion having average aspect ratio of 12.0

10% of an aqueous solution of silver nitrate (based on the whole amount of the silver nitrate solution) and an aqueous solution of potassium bromide were added to a solution containing potassium bromide and gelatin in a container while the pAg of the reaction mixture was maintained at 9.5, and subsequently, remaining 90% of the aqueous solution of silver nitrate and an aqueous solution of potassium bromide were added to the reaction mixture while the pAg in the reaction mixture was maintained at 9.2. Thus, a tabular silver bromide emulsion having an average grain diameter of 1.6 μm and an average aspect ratio of 12.0 (based on the projected area of grains) was obtained. The emulsion was chemically sensitized with sodium thiosulfate and chloroauric acid to obtain a light-sensitive silver bromide emulsion (M). Separately, by adding potassium iodide to two aqueous solutions of potassium bromide prepared as above, the same grain formation and chemical sensitization as for emulsion (M) were carried out to prepare a tabular light-sensitive silver iodide bromide emulsion (N) having an iodine content of 3 mol %, and a tabular light-sensitive silver iodide bromide emulsion (0) having an iodine content of 10 mol %.

Preparation of photoqraphic materials (1) Formaldehyde hardening agent (Comparative samples)

To each of emulsions (A), (B), (D), (E), (G), (H), (J), (K), (M), and (N), zinc hydroxide (having an average particle size of 0.3 micron) as a basic metallic salt substantially insoluble in water and formaldehyde as a hardening agent were added.

Further, sensitizing dye I, represented by the following formula, (Sensitizing Dye I)

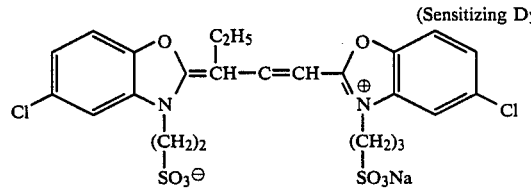

4-hydroxy-6-methyl-1,3,3a,7-tetrazaindene, polyethylene oxide, and 2,6-bis(hydroxyamino)-4-dimethylamino-triazine as stabilizers, trimethylol propane as a drying fog inhibitor, a dodecylbenzene sulfonic acid salt as a coating assistant, and polypotassium p-vinylbenzene sulfonate as a viscosity increasing agent were added to each of the above-mentioned emulsion to prepare coating solutions. Each coating solution was together with a coating solution for a protective surface layer which was prepared by adding polysodium styrene sulfonate, a fine powder of polymethyl methacrylate (having an average particle size of 3.0 μm), polyethylene oxide, and the like to an aqueous solution of gelatin, applied simultaneously to an undercoated polyethylene terephthalate substrate and subsequently, they were dried. Thus, photographic material Samples 1 to 10 containing each emulsion were obtained.

(2) 2,4-dichloro-6-hydroxy-s-triazine hardening (Invention)

By the same method as in (1) except that, as a hardening agent, 2,4-dichloro-6-hydroxy-s-triazine was used instead of formaldehyde, photographic materials Samples 11 to 20 containing emulsions (A), (B), (D), (E), (G), (H), (J), (K), (M), and (N) were obtained.

(3) Bis(vinylsulfonylacetamide)ethane hardening (Invention)

By the same method as in (1) except that, as a hardening agent, bis(vinylsulfonylacetamide)ethane was used instead of formaldehyde, photographic materials Samples 21 to 30 containing emulsions (A), (B), (D), (E), (G), (H), (J), (K), (M), and (N) were obtained.

In each of Samples 1 to 30, the coated weight of silver was 3.5 g/m$^2$, that of zinc hydroxide was 1.2 g/m$^2$, that of gelatin was 3.0 g/m$^2$, and that of the hardening agent was selected such that its scratch resistance measurement as set forth below was 100 g.

Measuring scratch resistance

After Sample was dipped in distilled water at 30° C. for 20 seconds, a stainless steel needle having a radius of 0.8 mm of the tip was put on the surface of sample. While the needle was moved horizontally on the film surface at a rate of 1 cm per second, the load on the needle was changed continuously in a range of 50 to 200 g. The load on the needle when the film surface was damaged was determined, and designated as its scratch resistance value.

Forming and evaluating image

Each of Samples 1 to 30 was exposed for 1/10 second using a filter cutting short-wavelength light of 480 nm or less. Each sample after being exposed was developed with Developing Solution A as set forth below at 20° C. for 2 minutes, and subsequently, fixed with Fixing Solution A as set forth below before being washed and dried. After that, each sample was tested for sensitometry.

The results are shown in Table 1. In Table 1, sensitivity (S) represents the reciprocal of the exposure necessary to obtain an image density of fog +0.2 by transmitted light. Graininess was determined as the standard deviation (RMS graininess) of transmissivity, when a microphotometer having a scanning aperture area of 48 μm diameter was used.

| Developing Solution A | |
|---|---|
| 1-phenyl-3-pyrazolidone | 0.5 g |
| Hydroquinone | 20.0 g |
| Potassium picolinate | 20.0 g |
| Ethylenediaminetetraacetic acid disodium dihydrate | 2.0 g |
| Potassium sulfite | 60.0 g |
| Boric acid | 4.0 g |
| Potassium carbonate | 20.0 g |
| Sodium bromide | 5.0 g |
| Diethylene glycol | 10 g |
| Water to make | 1 liter |
| pH adjusted to 10.0 with sodium hydroxide. | |
| Fixing Solution A | |
| Ammonium thiosulfate | 200 g |
| Sodium sulfite, anhydrous | 15 g |
| Glacial acetic acid | 15.4 ml |
| Boric acid | 7.5 g |
| Potassium alum | 15 g |
| Water to make | 1 liter |

-continued

TABLE 1

| Emulsion | Sample No. | S (Sensitivity) (1) | R (Development ratio) (2) (%) | RMS (Graininess) (3) |
|---|---|---|---|---|
| A | 1 | 100 | 69 | 0.026 |
| B | 2 | 120 | 67 | 0.024 |
| D | 3 | 90 | 69 | 0.027 |
| E | 4 | 110 | 68 | 0.024 |
| G | 5 | 118 | 70 | 0.027 |
| H | 6 | 136 | 66 | 0.024 |
| J | 7 | 125 | 73 | 0.030 |
| K | 8 | 148 | 71 | 0.028 |
| M | 9 | 130 | 73 | 0.033 |
| N | 10 | 153 | 72 | 0.031 |
| A | 11 | 110 | 73 | 0.022 |
| B | 12 | 132 | 71 | 0.020 |
| D | 13 | 101 | 72 | 0.022 |
| E | 14 | 119 | 71 | 0.020 |
| G | 15 | 121 | 74 | 0.023 |
| H | 16 | 138 | 72 | 0.021 |
| J | 17 | 145 | 77 | 0.026 |
| K | 18 | 160 | 75 | 0.023 |
| M | 19 | 148 | 78 | 0.028 |
| N | 20 | 164 | 75 | 0.027 |
| A | 21 | 109 | 72 | 0.023 |
| B | 22 | 133 | 72 | 0.021 |
| D | 23 | 100 | 73 | 0.021 |
| E | 24 | 119 | 72 | 0.020 |
| G | 25 | 120 | 73 | 0.022 |
| H | 26 | 136 | 72 | 0.020 |
| J | 27 | 147 | 78 | 0.026 |
| K | 28 | 161 | 77 | 0.022 |
| M | 29 | 149 | 77 | 0.029 |
| N | 30 | 161 | 75 | 0.027 |

(1) Sensitivity of sample 1 is taken as 100.

(2) Development ratio $R = \frac{\text{Silver amount in maximum density part}}{\text{Silver coating weight in sample}} \times 100$ (3) RMS graininess is the value in a part in which the density is 1.0.

As shown in Table I, Samples 11 to 30 containing the hardening agent of the present invention had a high development ratio (that is, develop rapidly) and high sensitivity and also had excellent graininess, as compared with Samples 1 to 10 (Comparative samples).

Example 2

(1) Formaldehyde hardening (Comparative samples)

To each, of emulsions (C), (F), (I), (L), and (O), formaldehyde as a hardening agent was added. Further, sensitizing dye II, represented by the following formula, (Sensitizing Dye II)

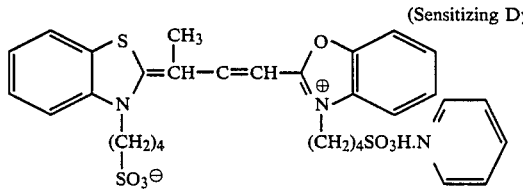

4-hydroxy-6-methyl-1,3,3a,7-tetrazaindene, polyethylene oxide, and 2,6-bis(hydroxyamino)-4-diethylamino-1,3,5triazine as stabilizers, trimethylol propane as a drying fog inhibitor, a dodecylbenzenesulfonic acid salt as a coating assistant, and polypotassium p-vinylbenzenesulfonate as a viscosity increasing agent were added to each of the above mentioned emulsions and thus, coating solutions A-1 were obtained. Then, an aqueous solution of gelatin containing zinc hydroxide (having an average particle size of 0.3 μm) as a basic metallic compound substantially in soluble in water, and the above-mentioned coating assistant and viscosity increasing agent was prepared as a coating solution B. A coating solution for a surface protective layer was prepared by adding polysodium styrene sulfonate, fine particles of polymethyl methacrylate, (having a particle size of 3.0 μm), and polyethylene oxide to an aqueous solution of gelatin. The surface protective layer solution, coating solution A-1, and coating solution B were applied simultaneously to a cellulose triacetate substrate so that a coating solution B layer, a coating solution A-1 layer, and a surface protective layer were disposed on the substrate in that order, and subsequently they were dried. Thus, Samples 31 to 35 containing each emulsion were obtained.

(2) 2,4-dichloro-6-hydroxy-s-triazine hardening (Invention)

The same additives as in (1) above except that, as a hardening agent, 2,4-dichloro-6-hydroxy-s-triazine was used instead of formaldehyde were added to each of emulsions (C), (F), (I), (L), and (O), and thus a coating solution A-2 was prepared. In the same manner as for solution A-1, coating solution A-2, together with coating solution B and the coating solution for a surface protective layer, were applied simultaneously to a substrate to obtain the same layer constitution as in (1) and then they were dried. Thus, Samples 36 to 40 were obtained. (3) 1,2-bis(vinylsulfonylacetamide) ethane hardening (Invention)

The same additives as in (1) above except that, as a hardening agent, 1,2-bis(vinylsulfonylacetamide)ethane was used instead of formaldehyde were added to each of emulsions (C), (F), (I), (L), and (O), and thus a coating solution A-3 was prepared. Coating solution A-3, together with coating solution B and the coating solution for a surface protective layer, were applied simultaneously to a substrate to obtain the same layer constitution as in (1) and subsequently, they were dried. Thus, Samples 41 to 45 were obtained.

In the above-prepared Samples, the coating weight of silver was 3.5 g/m$^2$, that of zinc hydroxide was 1.2 g/m$^2$, and that of gelating was 3.0 g/m$^2$. The amount of hardening agent was selected so that the scratch resistance measurement for the sample was 100 g.

Forming and evaluating image

Each of Samples 31 to 45 was exposed for 1/100 second using a light source equivalent to radiation of a black body at 5,400° K. Each sample after being exposed was developed at 20° C. for 7 minutes with Developing Solution B as set forth below, and subsequently, fixed with Fixing Solution B as set forth below before being washed and dried. The thus obtained samples were tested for sensitivity. The results are shown in Table 2. Sensitivity (S) and graininess (RMS) were determined by the same method as in example 1.

| Developing Solution B | |
|---|---|
| Metol | 2 g |
| Sodium sulfite anhydride | 100 g |
| Potassium picolinate | 20.0 g |
| Hydroquinone | 5.0 g |
| Boric acid | 2.0 g |
| Water to make | 1 liter |
| Fixing Solution B | |

-continued

| | |
|---|---|
| Sodium thiosulfate | 240 g |
| Sodium sulfite anhydride | 15 g |
| Acetic acid (28%) | 48 ml |
| Boric acid | 7.5 g |
| Potassium alum | 15 g |
| Water to make | 1 liter |

TABLE 2

| Emulsion | Sample No. | S (Sensitivity) (1) | R (Development ratio) (2) (%) | RMS (Graininess) (3) |
|---|---|---|---|---|
| C | 31 | 100 | 51 | 0.022 |
| F | 32 | 95 | 49 | 0.021 |
| I | 33 | 92 | 49 | 0.021 |
| L | 34 | 120 | 53 | 0.025 |
| O | 35 | 131 | 53 | 0.026 |
| C | 36 | 105 | 55 | 0.018 |
| F | 37 | 101 | 53 | 0.018 |
| I | 38 | 98 | 54 | 0.017 |
| L | 39 | 130 | 59 | 0.019 |
| O | 40 | 135 | 60 | 0.020 |
| C | 41 | 107 | 57 | 0.018 |
| F | 42 | 102 | 53 | 0.017 |
| I | 43 | 100 | 55 | 0.017 |
| L | 44 | 130 | 59 | 0.020 |
| O | 45 | 134 | 61 | 0.022 |

(1) Sensitivity of sample 31 is taken as 100.

(2) Development ratio $R = \frac{\text{Silver amount in maximum density part}}{\text{Silver coating weight in sample}} \times 100$ (3) RMS graininess is the value in a part in which the density is 1.0.

As shown in Table 2, even when zinc hydroxide as a basic metallic compound substantially insoluble in water was added to a layer other than an emulsion layer, Samples 36 to 45 using the hardening agent of the present invention had a high development ratio (that is, developed rapidly) and high sensitivity, and also had excellent graininess, as compared with Samples 31 to 35. (comparative samples).

While the invention has been described in detail and with reference to specific embodiments thereof, it will be apparent to one skilled in the art that various changes and modifications can be made therein without departing from the spirit and scope thereof.

What is claimed is:

1. A method for forming a silver image comprising the steps of:

(a) imagewise exposing a light-sensitive silver halide photographic material comprising a support having provided on at least one surface thereof a light-sensitive chemically sensitized silver halide emulsion, at least one of an active halogen hardening agent and a bisvinylsulfone hardening agent, and a slightly water-soluble basic metallic compound; and (b) developing said exposed material with a developer solution containing a compound capable of reacting with said basic metallic compound to release a base.

2. The method as claimed in claim 1, wherein said active halogen hardening agent is represented by formula (I) or (II):

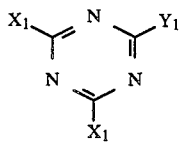

(I)

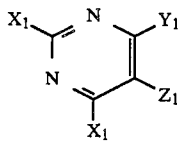

(II)

wherein $X_1$ represents a halogen atom, an N-methylolamino group or a glycidoxy group; and $Y_1$ and $Z_1$, which may be the same or different, each represents a hydrogen atom; a halogen atom; —OH; —OM, wherein M represents an alkali metal ion; a substituted or unsubstituted amino group; a substituted or unsubstituted alkyl ether group; a substituted or unsubstituted phenyl ether group; a substituted or unsubstituted alkyl thioether group; a substituted or unsubstituted phenyl thioether group; a sulfonamido group; or an alkyl sulfonamido group.

3. The method as claimed in claim 2, wherein $X_1$ represents a chlorine atom; and $Y_1$ represents a substituted alkylamino group or a substituted arylamino group, each substituted with a sulfonic group or a carboxyl group, or —OM, wherein M represents an alkali metal ion.

4. The method as claimed in claim 2, wherein said hardening agent is selected from the group consisting of:

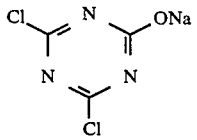

(I-1)

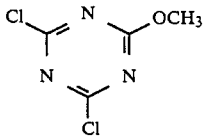

(I-2)

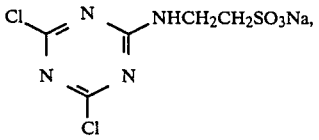

(I-4)

and

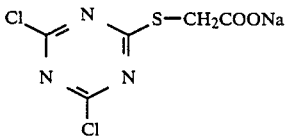

(I-10)

5. The method as claimed in claim 1, wherein said bisvinylsulfone hardening agent is represented by formula (III):

$$CH_2{=}CHSO_2{-}R_{11}{-}SO_2CH{=}CH_2 \qquad \text{(III)}$$

wherein $R_{11}$ represents a divalent linking group comprising a group selected from the group consisting of an unsubstituted alkylene group; an alkylene group substituted with a halogen atom, a hydroxyl group, a hydroxylalkyl group and an amino group.

6. The method as claimed in claim 5, wherein said divalent linking group further comprises at least one of —CONH—, —O—, or —S—.

7. The method as claimed in claim 6, wherein said divalent linking group is selected from $$\text{-}(CH_2)_s O (CH_2)_s\text{-},\ \text{-}(CH_2)_s \overset{OH}{\overset{|}{C}}H (CH_2)_s\text{-},\ \text{or}$$

$$\text{-}CH_2CONH(CH_2)_s NHCOCH_2\text{-},$$

wherein s represents an integer of from 1 to 5.

8. The method as claimed in claim 5, wherein said hardening agent is selected from the group consisting of:

$$CH_2{=}CHSO_2CH_2OCH_2SO_2CH{=}CH_2 \qquad \text{(III-4)}$$

$$CH_2{=}CHSO_2CH_2\overset{OH}{\overset{|}{C}}HCH_2SO_2CH{=}CH_2 \qquad \text{(III-6)}$$

$$\left.\begin{array}{l} CH_2{=}CHSO_2CH_2CONH \\ CH_2{=}CHSO_2CH_2CONH \end{array}\right\}(CH_2)_2\text{, and} \qquad \text{(III-7)}$$

$$\left.\begin{array}{l} CH_2{=}CHSO_2CH_2CONH \\ CH_2{=}CHSO_2CH_2CONH \end{array}\right\}(CH_2)_3 \qquad \text{(III-8)}$$

9. The method as claimed in claim 1, wherein said basic metallic compound is represented by formula (IV):

$$T_mX_n \qquad \text{(IV)}$$

wherein T represents a transition metal or an alkaline earth metal, X represents a basic anion, and m and n each is an integer required for charge balance.

10. The method as claimed in claim 9, wherein said transition metal is selected from the group consisting of Zn, Ni, Co, Fe, and Mn; said alkaline earth metal is selected from the group consisting of Ca, Ba, and Mg; and said basic anion is selected from the group consisting of a carbonate ion, a phosphate ion, a silicate ion, a borate ion, an aluminate ion, a hydroxide ion and an oxygen atom.

11. The method as claimed in claim 9, wherein said basic metallic compound is selected from the group consisting of calcium carbonate, barium carbonate, magnesium carbonate, zinc carbonate, strontium carbonate, magnesium calcium carbonate, magnesium oxide, zinc oxide, tin oxide, cobalt oxide, zinc hydroxide, aluminum hydroxide, magnesium hydroxide, calcium hydroxide, antimony hydroxide, tin hydroxide, iron hydroxide, bismuth hydroxide, manganese hydroxide, calcium phosphate, magnesium phosphate, magnesium borate, calcium silicate, magnesium silicate, zinc aluminate, calcium aluminate, basic zinc carbonate, basic magnesium carbonate, basic nickel carbonate, basic bismuth carbonate, basic cobalt carbonate, and aluminum magnesium oxide.

12. The method as claimed in claim 1, wherein said compound capable of reacting with said basic metallic compound to release a base is a compound capable of forming a complex with a metal ion contained in said basic metallic compound to form a complex salt having a stability constant of at least about 1.

13. The method as claimed in claim 12, wherein said compound capable of forming a complex is a salt selected from the group consisting of an alkali metal salt, a guanidine salt, an amidine salt, and a quaternary ammonium salt of an aminocarboxylic acid, an imidine acetic acid, an aniline carboxylic acid, a pyridine carboxylic acid, an aminophosphoric acid, a carboxylic acid, a hydroxamic acid, a polyacrylic acid, and a polyphosphoric acid.

14. The method as claimed in claim 13, wherein said acid is selected from the group consisting of picolinic acid, 2,6-pyridinedicarboxylic acid, 2,5-pyridinedicarboxylic acid, 4-dimethylaminopyridine-2,6-dicarboxylic acid, quinoline-2-carboxylic acid, 2-pyridine acetic acid, oxalic acid, citric acid, tartaric acid, isocitric acid, malic acid, gluconic acid, ethylenediaminetetraacetic acid, nitrilotriacetic acid, cyclohexanediaminotetraacetic acid, hexametaphosphoric acid, tripolyphosphoric acid, tetraphosphoric acid,

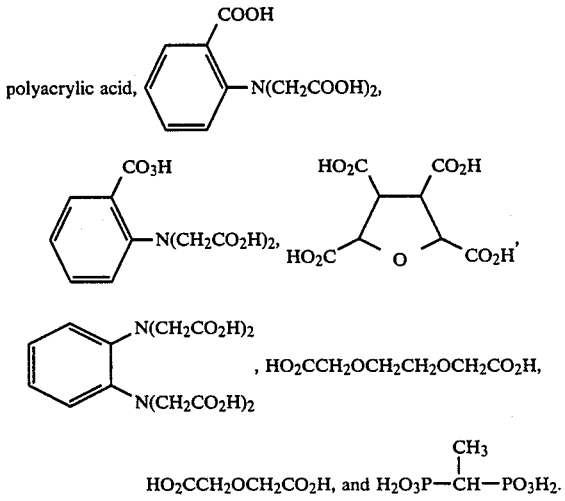

15. The method as claimed in claim 13, wherein said compound capable of forming a complex is represented by formula (V):

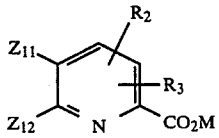

(V)

wherein $R_2$, $R_3$, $Z_{11}$ and $Z_{12}$, which may be the Same or different, each represents a hydrogen atom, an aryl group, a halogen atom, an alkoxy group, —COOM, a hydroxycarbonyl group or an electron-donating group selected from an amino group, a substituted amino group and an alkyl group; and M represents an alkali metal ion, a guanidine ion, an amidine ion, or a quaternary ammonium ion.

16. The method as claimed in claim 2, wherein said hardening agent is present in an amount of from about $0.5\times10^{-3}$ to $1.0\times10^{-1}$ mol per 100 g of hardenable binders contained in said light-sensitive material; said basic metallic compound is a powder having an average particle size of up to about 50 μm, and is present in an amount of from about 0.01 to 20 g/m$^2$ of said material; and said compound capable of reacting with said basic metallic compound is present in an amount of from about 0.01 to 5 mol per liter of said developer solution.

17. The method as claimed in claim 16, wherein said hardening agent is present in an amount of from about $1.0\times10^{-3}$ to $3.0\times10^{-2}$ mol per 100 g of said hardenable binders; and said basic metallic compound particles have an average particle size of up to about 5 μm and are present in an amount of from about 0.1 to 5 g/m$^2$ of said material.

18. The method as claimed in claim 5, wherein said hardening agent is present in an amount of from about $1.0\times10^{-3}$ to $1.0\times10^{-1}$ mol per 100 g of hardenable binders contained in said light-sensitive material; said basic metallic compound is a powder having an average particle size of up to about 50 μm, and is present in an amount of from about 0.01 to 20 g/m$^2$ of said material; and said compound capable of reacting with said basic metallic compound is present in an amount of from about 0.01 to 5 mol per liter of said developer solution.

19. The method as claimed in claim 18, wherein said hardening agent is present in an amount of from about $3.0\times10^{-3}$ to $3.0\times10^{-2}$ mol per 100 g of said hardenable binders; and said basic metallic compound particles have an average particle size of up to about 5 μm and are present in and amount of from about 0.1 to 5 g/m$^2$ of said material.

20. The method as claimed in claim 1, wherein said silver halide emulsion layer comprises silver iodobromide grains containing up to about 30 mol % silver iodide, having an average grain size of at least about 0.3 μm.

21. The method as claimed in claim 20, wherein said silver halide emulsion comprises silver bromoiodide grains containing up to about 15 mol % silver iodide, having an average grain size of from about 0.5 to 2.0 μm.

22. The method as claimed in claim 1, wherein said hardening agent is contained in said silver halide emulsion layer, a protective layer, or an undercoat layer and said basic metallic compound is contained in said silver halide emulsion layer, an intermediate layer, a protective layer, an antihalation layer, or a backing layer.

23. The method as claimed in claim 1, wherein said photosensitive material is an X-ray material.

24. The method as claimed in claim 23, wherein said X-ray material comprises a support having on both surfaces thereof said light-sensitive silver halide emulsion layer, said layer containing said hardening agent, and said layer containing said basic metallic compound.

25. The method as claimed in claim 1, wherein said light-sensitive silver halide emulsion, said at least one of an active halogen hardening agent and a bisvinylsulfone hardening agent, and a slightly water-soluble basic metallic compound are present in the same layer or in the layers adjacent to each other.

26. The method as claimed in claim 1, wherein said silver halide is sensitized by a gold-sulfur sensitization method.

27. The method as claimed in claim 1, wherein said silver halide is further spectrally sensitized.

* * * * *